US007665388B2

(12) United States Patent
Chen

(10) Patent No.: US 7,665,388 B2
(45) Date of Patent: Feb. 23, 2010

(54) PEDAL ADJUSTABLE DEVICE FOR EXERCISERS

(75) Inventor: Ming Nan Chen, Taichung (TW)

(73) Assignee: Michael Lin, Taipei (TW)

( * ) Notice: Subject to any disclaimer, the term of this patent is extended or adjusted under 35 U.S.C. 154(b) by 192 days.

(21) Appl. No.: 11/894,465

(22) Filed: Aug. 21, 2007

(65) Prior Publication Data

US 2009/0049950 A1 Feb. 26, 2009

(51) Int. Cl.
*G05G 1/30* (2008.04)
*A63B 23/08* (2006.01)
*A63B 23/10* (2006.01)

(52) U.S. Cl. ..... 74/561; 74/560; 74/562; 74/562.5; 74/512; 74/564; 482/51; 482/52; 482/80

(58) Field of Classification Search ..... 74/560, 74/561, 562, 562.5, 512; 482/80, 79, 51, 482/52

See application file for complete search history.

(56) References Cited

U.S. PATENT DOCUMENTS 3,563,129 A * 2/1971 Cantrell ..... 84/422.1

7,037,242 B2 * 5/2006 Lo et al. ..... 482/52

FOREIGN PATENT DOCUMENTS

KR 2005115418 A * 12/2005

* cited by examiner

*Primary Examiner*—Richard W L Ridley
*Assistant Examiner*—Daniel Yabut
(74) *Attorney, Agent, or Firm*—Charles E. Baxley

(57) ABSTRACT

A pedal adjustable device includes a case fixed to an end of a link and a first member and a second member are connected between two sidewalls of the case respectively. The first part includes a polygonal hole and the second part includes a circular hole. The polygonal hole is larger than the circular hole. A support plate has one end pivotably connected to the case and an extension extends from an underside of the other end of the support plate. A pedal is fixed on the support plate. The extension includes an elongate hole and a plurality pairs of protrusions extend from two insides of the elongate hole to define a space between each pair of the protrusion. An operation member includes a polygonal section and a circular rod. The polygonal section is engaged with the polygonal hole and set on one of pairs of the protrusions.

5 Claims, 6 Drawing Sheets

PEDAL ADJUSTABLE DEVICE FOR EXERCISERS

FIELD OF THE INVENTION

The present invention relates to a pedal adjustable device for elliptical exercisers and the angle of the pedals can be easily adjusted by pulling a handle.

BACKGROUND OF THE INVENTION

A conventional pedal adjustable device for exercisers such as an elliptical exerciser, is shown in FIG. 1 and generally includes a pedal 1 which has one end pivotably connected to a board 11 and the other end of the pedal 1 has a protrusion 13 extending from an underside thereof. The protrusion 13 includes three holes 14 and a pin 15 extends through the board 11 and one of the holes 14 to adjust the angle of the pedal 1 relative to the board 11. The board 11 is pivotably connected to a link 12 which is moved when operating the elliptical exerciser. The user has to remove the pin 15 out from the hole 14 and the board 11 by one hand and pivot the pedal 1 by the other hand to move the desired hole 14 to the position where the pin 15 is located. This is inconvenient for the users and may take a long time to align the hole 14 and the pin 15.

The present invention intends to provide a pedal adjustable device for elliptical exerciser and the device includes a handle which does not need to be pulled out from the parts of the exerciser and can be easily set at desired position.

SUMMARY OF THE INVENTION

The present invention relates to a pedal adjustable device and comprises a case fixed to an end of a link and a first member and a second member are connected between two sidewalls of the case respectively. The first part includes a polygonal hole and the second part includes a circular hole, the polygonal hole is larger than the circular hole. A support plate has a first end pivotably connected to the case and an extension extends from an underside of a second end of the support plate. The extension includes an elongate hole defined axially therethrough and a plurality pairs of protrusions extend from two insides of the elongate hole so as to define a space between each pair of the protrusion. The extension is located between the first and second members and a pedal is fixed on the support plate. An operation member has a handle and a shank connected to the handle. The shank includes a polygonal section which has one end connected to the handle and a circular rod is connected to the other end of the polygonal section. The circular rod extends through the polygonal hole, the elongate slot and the circular hole. The polygonal section is engaged with the polygonal hole, the space between each pair of the protrusion is larger than the circular rod and smaller than the polygonal section.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
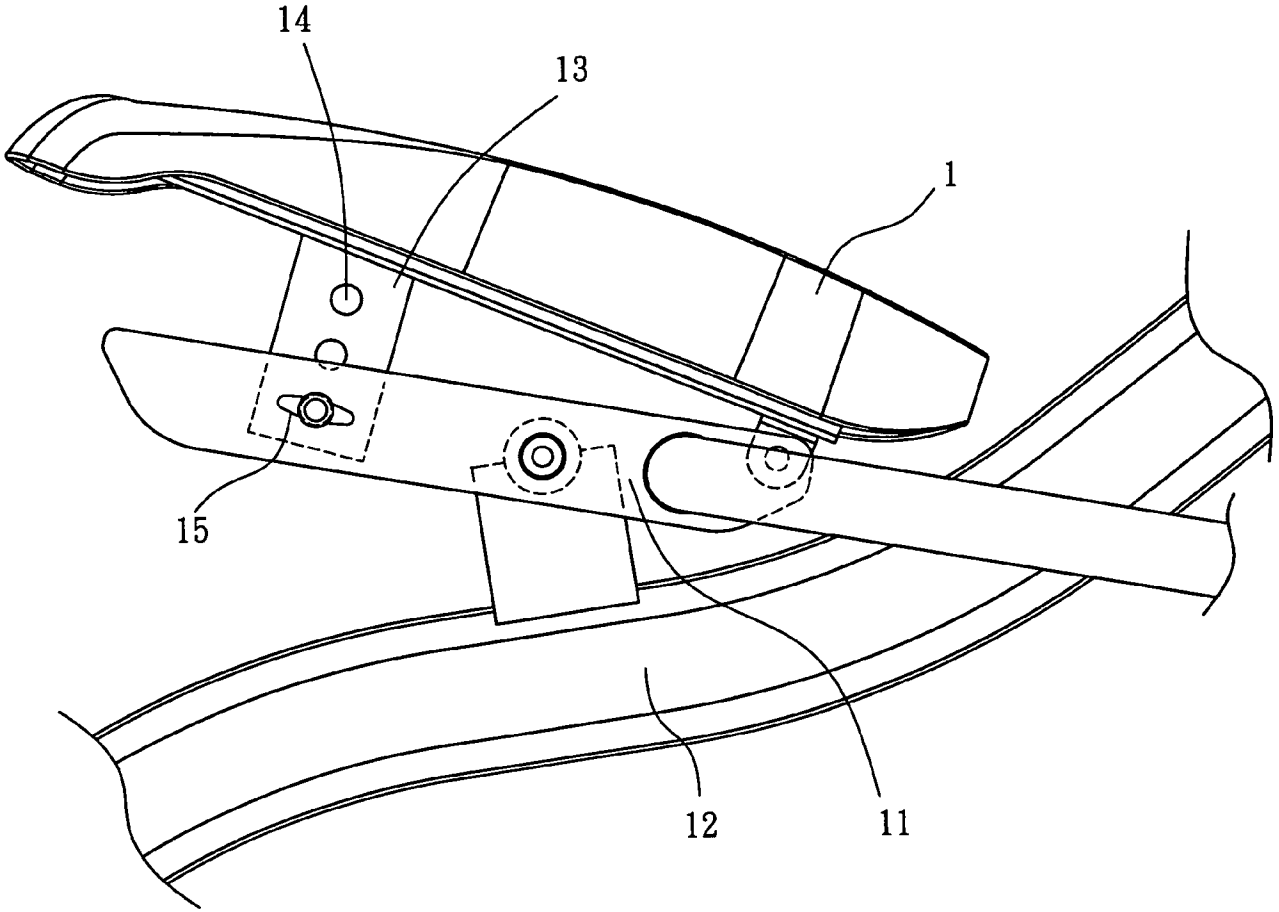
FIG. 1 PRIOR ART
FIG. 1 shows a conventional pedal adjustable device.
Figure 2:
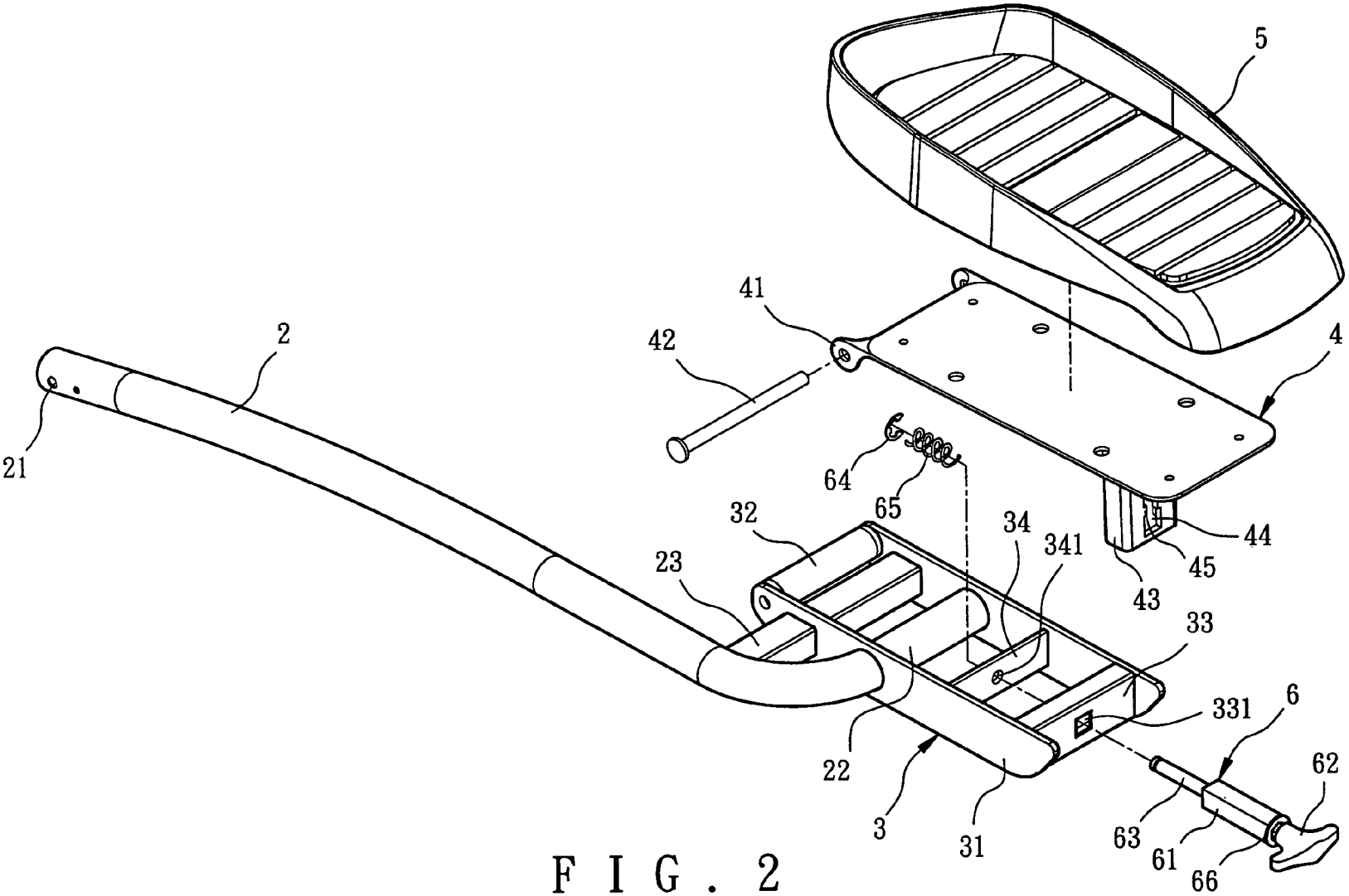
FIG. 2 is an exploded view to show the pedal adjustable device of the present invention.
Figure 3:
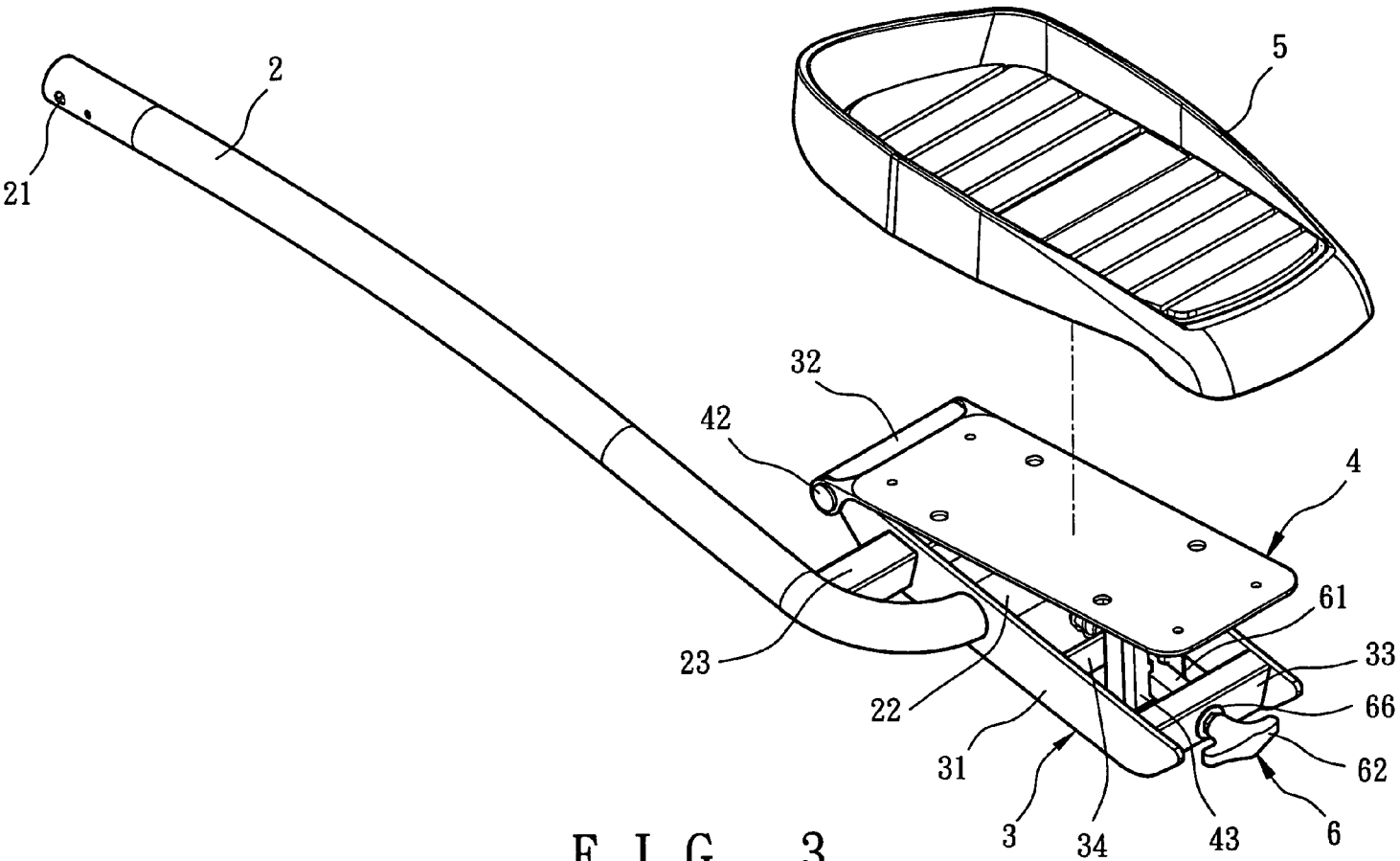
FIG. 3 shows that the support plate is pivotably connected to the case of the pedal adjustable device of the present invention and the pedal is to be connected to the support plate.
Figure 4:
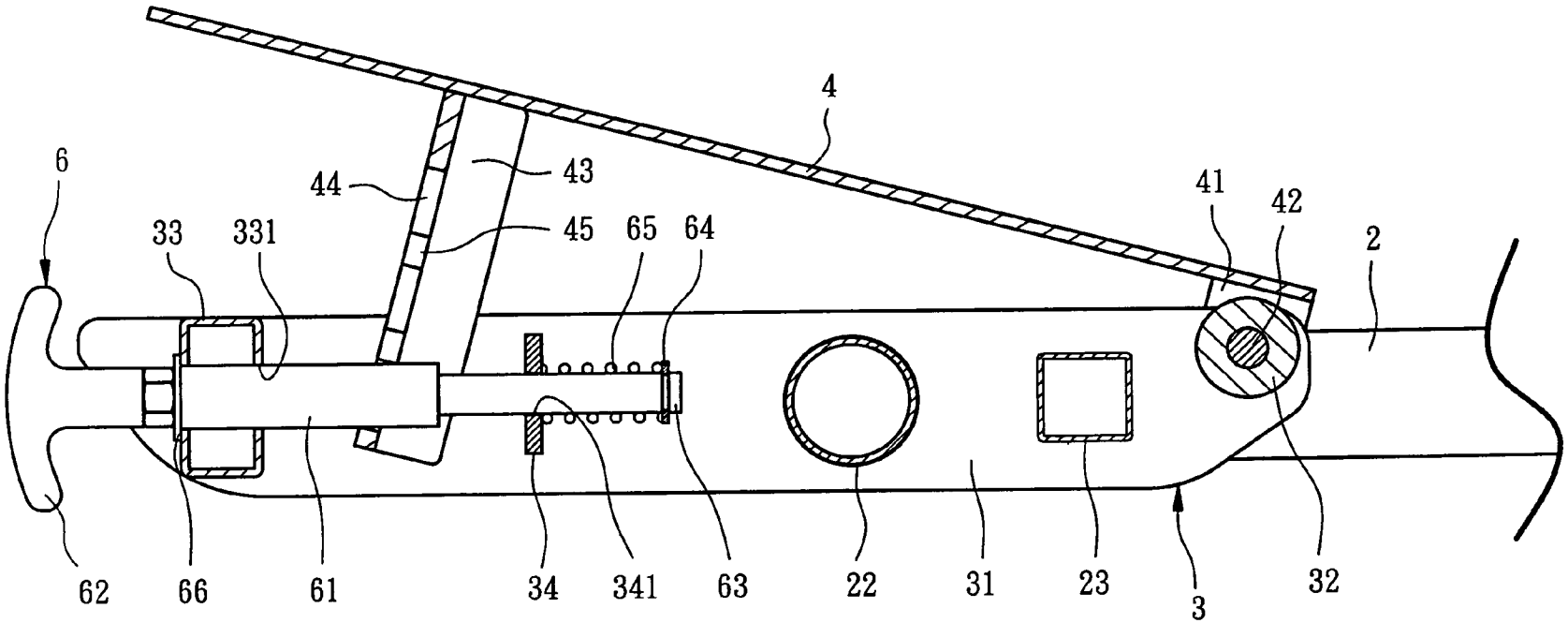
FIG. 4 is a side view to show the pedal is set at a first angle.
Figure 5:
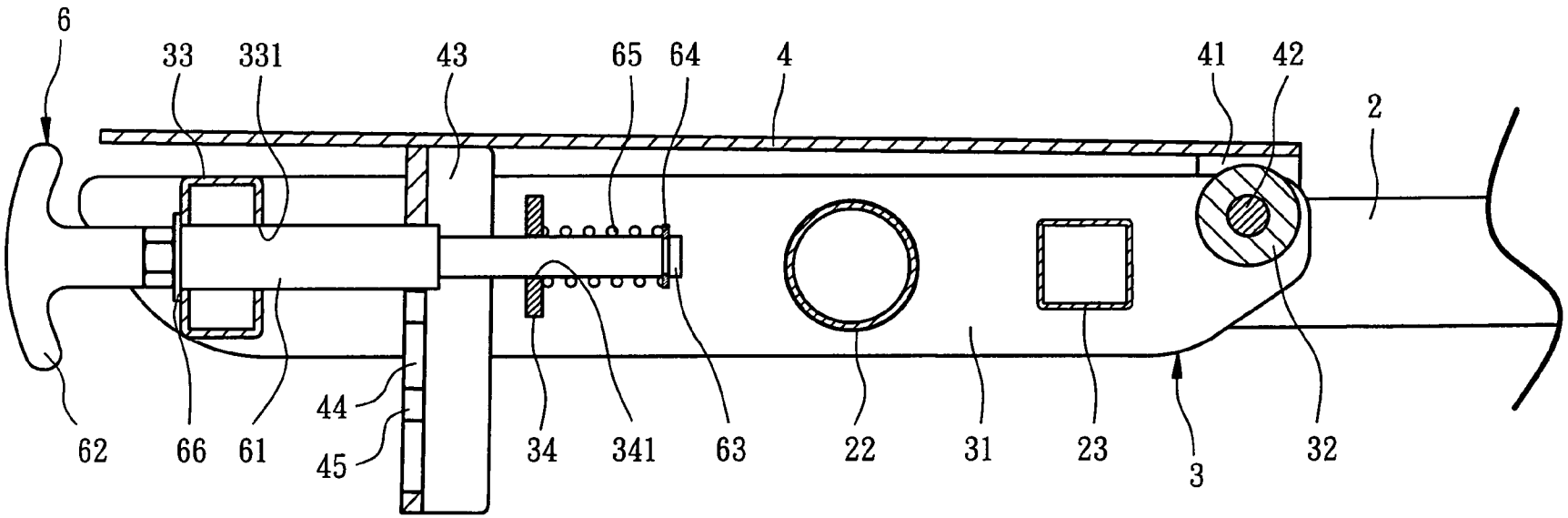
FIG. 5 is a side view to show the pedal is set at a second angle.
Figure 6:
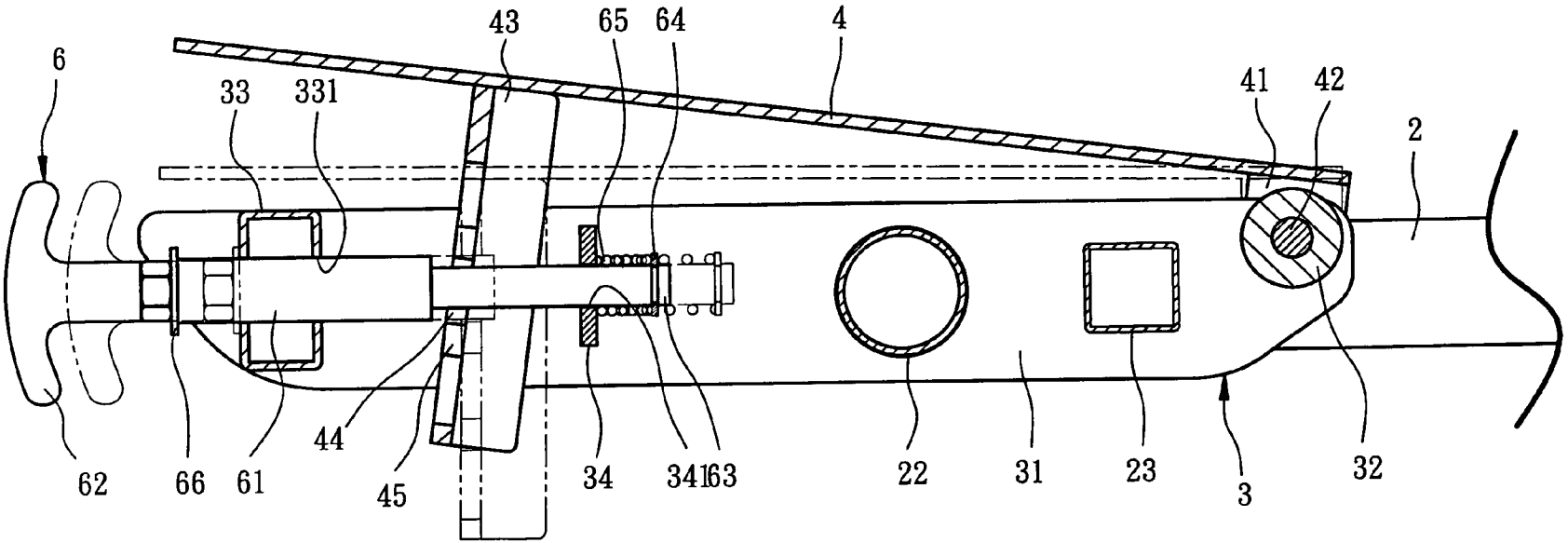
FIG. 6 shows that operation member is operated to adjust the angle of the pedal.

Referring to FIGS. 2 to 6, the pedal adjustable device of the present invention comprises a case 3 fixed to a bent portion 22 at an end of a link 2 and the other end of the link 2 is connected to an elliptical exerciser which is not shown. The bent portion 22 extends through the first one of the two sidewalls 31 and is fixed to the second one of the two sidewalls 31. A polygonal part 23 has one end fixedly connected to the link 21 and the other end of the polygonal part 23 extends through the first one of the two sidewalls 31 and is fixed to the second one of the two sidewalls 31. By this arrangement, the case 3 is fixed to the link 2. A first member 33 and a second member 34 are connected between the two sidewalls 31 of the case 3 respectively. The first member 33 includes a polygonal hole 331 defined therethrough and the second member 34 includes a circular hole 341 defined therethrough. The polygonal hole 331 is larger than the circular hole 341. A tube 32 is connected between the two sidewalls 31 of the case 3.

A support plate 4 has two lugs 41 extending from a first end thereof and the two lugs 41 are located on two ends of the tube 32, a pin 42 extends through the two lugs 41 and the tube 32 such that the support plate 4 is pivotably connected to the case 3. An extension 43 extends from an underside of a second end of the support plate 4 and includes an elongate hole 44 defined axially therethrough. A plurality of pairs of protrusions 45 extends from two insides of the elongate hole 44 so as to define a space between each pair of the protrusion 45. The extension 43 is located between the first and second members 33, 34. A pedal 5 is fixed on the support plate 4.

An operation member 6 has a handle 62 and a shank connected to the handle 62. The shank includes a polygonal section 61 which has one end connected to the handle 62 and a circular rod 63 is connected to the other end of the polygonal section 61. The circular rod 63 extends through the polygonal hole, the elongate slot 44 and the circular hole 341. A spring 65 is mounted to the circular rod 63 and biased between a restriction ring 64 connected to the circular rod 63 and the second member 34. A ring 66 is mounted to the shank and located between the handle 62 and the polygonal section 61. The polygonal section 61 is engaged with the polygonal hole 2331, the space between each pair of the protrusions 46 is larger than the circular rod 63 and smaller than the polygonal section 61 so that the polygonal section 61 cannot pass through the space between each pair of the protrusions 45 and the angle of the pedal relative to the case 31 can be determined.

When adjusting the pedal 5, the user holes the handle 62 and pulls the operation member 6 to compress the spring 65 until the polygonal section 61 is disengaged from the elongate hole 44 in the extension 43, the circular rod 63 can be freely moved through the spaces between the protrusions 45. The pedal 5 together with the support plate 4 are pivoted to a desired angle, the operation member 6 is released to let the polygonal section 61 is engaged with the elongate hole 44 again to set the angular position of the pedal 5. Because the polygonal section 61 cannot pass through the spaces between the protrusions 45 so that the position of the pedal 5 is set.

The user needs not to align the operation member 6 with the circular hole 341, the polygonal hole 331 and the elongate hole 44 during adjusting the pedal 5.

While we have shown and described the embodiment in accordance with the present invention, it should be clear to those skilled in the art that further embodiments may be made without departing from the scope of the present invention.

What is claimed is:

1. A pedal adjustable device comprising:

a case fixed to an end of a link and including a first member and a second member connected between two sidewalls of the case respectively, the first member including a polygonal hole defined therethrough and the second member including a circular hole defined therethrough, the polygonal hole being larger than the circular hole;

a support plate having a first end pivotably connected to the case and an extension extending from an underside of a second end of the support plate, the extension including an elongate hole defined axially therethrough and a plurality of pairs of protrusions extending from two insides of the elongate hole so as to define a space between each pair of the protrusions, the extension is located between the first and second members, a pedal fixed on the support plate; and an operation member having a handle and shank connected to the handle, the shank including a polygonal section which has one end connected to the handle and a circular rod connected to the other end of the polygonal section, the circular rod extending through the polygonal hole, the elongate hole and the circular hole, the polygonal section engaged with the polygonal hole, the space between each pair of the protrusions being larger than the circular rod and smaller than the polygonal section so that the polygonal section engages at least one of said pairs of the protrusions and the angle of the pedal relative to the case can be determined.

2. The device as claimed in claim 1, wherein a spring is mounted to the circular rod and biased between a restriction ring connected to the circular rod and the second member.

3. The device as claimed in claim 1, wherein a tube is connected between the two sidewalls of the case and two lugs extend from the first end of the support plate, the two lugs are located on two ends of the tube and a pin extends through the two lugs and the tube such that the support plate is pivotably connected to the case.

4. The device as claimed in claim 1, wherein the link includes a bent portion which extends through a first one of the two sidewalls and is fixed to a second one the two sidewalls.

5. The device as claimed in claim 1 further comprising a polygonal part having a first end fixedly connected to the link and a second end extending through a first one of the two sidewalls and fixed to a second one of the two sidewalls.

* * * * *